US005607366A

United States Patent [19]

Yokota et al.

[11] Patent Number: 5,607,366

[45] Date of Patent: Mar. 4, 1997

[54] TWO-PIECE GOLF BALL

[75] Inventors: Masatoshi Yokota, Mino; Kuniyasu Horiuchi, Kobe; Hidenori Hiraoka, Kobe; Mikio Yamada, Kobe, all of Japan

[73] Assignee: Sumitomo Rubber Industries, Ltd., Hyogo-ken, Japan

[21] Appl. No.: 426,911

[22] Filed: Apr. 21, 1995

[30] Foreign Application Priority Data

Apr. 22, 1994 [JP] Japan ..... 6-084410

[51] Int. Cl.[6] ..... A63B 37/06; A63B 37/12

[52] U.S. Cl. ..... 473/372; 473/377; 473/378; 273/DIG. 22

[58] Field of Search ..... 273/230; 473/372, 473/377, 378

[56] References Cited

U.S. PATENT DOCUMENTS 4,650,193 3/1987 Molitor et al. ..... 273/230 X
5,304,608 4/1994 Yabuki et al. ..... 273/230 X

FOREIGN PATENT DOCUMENTS 0545541 6/1993 European Pat. Off. .
0589647 3/1994 European Pat. Off. .
0600662 6/1994 European Pat. Off. .
2185890 8/1987 United Kingdom .

*Primary Examiner*—George J. Marlo
*Attorney, Agent, or Firm*—Birch, Stewart, Kolasch & Birch, LLP

[57] ABSTRACT

A two-piece golf ball, comprising:

a core having a surface hardness of 55 to 75 and a sectional hardness at the location other than the core surface layer of 65 to 88, said hardness value being determined by a JIS-C type hardness tester; and a cover covering said core and having a stiffness of 1,000 to 3,000 kg/cm$^2$;

wherein said golf ball exhibits a contact area S between itself and a clubface, when hit with a driver at a head speed of 40 m/second, of 4.3 to 5.0 cm$^2$, S being determined by the equation:

$$S=\pi(\tfrac{1}{2}\{(a+b)/2\})^2$$

wherein a is a transverse diameter of the contact area and b is a longitudinal diameter of the contact area.

13 Claims, No Drawings

TWO-PIECE GOLF BALL

FIELD OF THE INVENTION

The present invention relates to a golf ball. More particularly, it relates to a two-piece golf ball comprising a core and a cover covering the core.

BACKGROUND OF THE INVENTION

It is normally difficult to put spin on a two-piece golf ball in comparison with a thread-wound golf ball. Therefore, the two-piece golf ball has a drawback that it attains a large flying distance but shows a trajectory having a small landing angle and it hardly stops when hit by iron clubs. For example, regarding the two-piece golf ball disclosed in Japanese Laid-Open Patent Publication No. 1988-73979, the amount of spin produced by an iron shot is particularly insufficient because the stiffness of the cover is high, i.e. 4,000 to 5,000 kg/cm$^2$.

In order to enhance spin performances of the two-piece golf ball, it has hitherto been conducted to decrease the thickness of the cover, or to decrease the stiffness of the cover (i.e. the hardness of the cover is softened), or to increase the hardness of the core, thereby decreasing the amount of compression deformation of the golf ball.

When the cover is softened, spin performances are improved but the initial velocity of the batted golf ball becomes small, which results in reduced flying distance. Further, when the amount of compression deformation is decreased, the hit feeling of the golf ball becomes inferior. For example, the hit feeling of the golf ball disclosed in Japanese Laid-Open Patent Publication No. 63-73979 is too hard in view of the latest tendency that many golf players like a soft hit feeling.

OBJECTS OF THE INVENTION

The present invention has been accomplished in order to solve the above conventional problems, that is, the main object of the present invention is to provide a two-piece golf ball having excellent flying performances and good hit feeling as well as excellent spin performances.

This object as well as other objects and advantages of the present invention will become apparent to those skilled in the art from the following description.

SUMMARY OF THE INVENTION

The present invention provides a two-piece golf ball comprising a core and a cover covering said core, characterized by having a contact area between a ball and a clubface of 4.3 to 5.0 cm$^2$ when hitting with a driver at a head speed of 40 m/second.

DETAILED DESCRIPTION of THE INVENTION

In the present specification, the term "contact area between a golf ball and a clubface" means the area of the part at which the trace of the golf ball contacted is observed, after hitting the golf ball with a driver wherein a pressure-sensitive paper has been adhered on the clubface. The area S of the part contacted with the golf ball is represented by the equation:

$$S=\pi[\tfrac{1}{2}\{(a+b)/2\}]^2$$

[wherein a is a transverse diameter of the part contacted with the golf ball, and b is a longitudinal diameter of the part contacted with the golf ball].

When the contact area between the golf ball and clubface is larger than 5.0 cm$^2$, the flying distance is decreased and the hit feeling becomes too heavy. On the other hands, when the contact area is smaller than 4.3 cm$^2$, the spin performances are deteriorated and the hit feeling becomes too hard.

The core to be used for the two-piece golf ball of the present invention is obtained by adjusting the vulcanization condition, formulation ratio, etc. according to a normal method. The formulation composition for forming the core normally contains base rubbers, crosslinking agents, cocrosslinking agents, inert fillers and the like.

As the base rubber in the present invention, there can be used a natural rubber and/or synthetic rubber which have hitherto been used for the core of the two-piece golf ball. Particularly, 1,4-polybutadiene rubber having at least 40% of a cis-structure is preferred. If necessary, natural rubber, polyisoprene rubber, styrene-butadiene rubber, EPDM, etc. may be formulated in the polybutadiene rubber. Examples of the crosslinking agent include organic peroxides such as dicumyl peroxide, t-butyl peroxide and the like. Among them, dicumyl peroxide is particularly preferred in view of vulcanizing rate and physical properties of the core.

The amount of the crosslinking agent is 0.3 to 5.0 pads by weight, preferably 0.5 to 3.0 parts by weight, based on 100 parts by weight of the base rubber.

The cocrosslinking agent is not specifically limited, and examples thereof include metal salts of unsaturated fatty acids, particularly monovalent or divalent metal salts of unsaturated fatty acids having 3 to 8 carbon atoms (e.g. acrylic acid and methacrylic acid). Zinc acrylate is particularly preferred, because the resulting golf ball Is superior In impact resilience and hit feeling.

The amount of the cocrosslinking agent is 20 to 40 parts by weight, preferably 22 to 37 parts by weight, based on 100 parts by weight of the base rubber.

As the inert filler, there can be normally used zinc oxide, barium sulfate and the like. The amount varies depending upon the specific gravity and size of the cover and core, and is not specifically limited. Normally, it is 10 to 60 parts by weight, based on 100 parts by weight of the base rubber.

The rubber composition obtained by formulating the above components is sufficiently kneaded, followed by subjectlong to a vulcanization molding in a die to form a core for two-piece golf ball. In that case, there can be used the kneading and vulcanizing conditions which are known to those skilled in the art.

The resulting core is coated with a cover having a suitable thickness. The method for coating the core with the cover is known to the public, and an injection molding is normally used.

The contact area between the golf ball and clubface when hitting with a driver at a head speed of 40 m/second is optimized by suitably adjusting the hardness of the interior of the core and surface as well as stiffness of the cover.

In one embodiment of the present invention, the vulcanizing condition and formulation ratio are adjusted so that the surface hardness of the core becomes within a range of 55 to 75, preferably 62 to 73 and the sectional hardness at the part other than the surface layer of the core becomes within a range of 65 to 85, preferably 70 to 80. For example, a desirable hardness can be realized by vulcanizing a formulated composition containing 20 to 40 parts by weight of zinc acrylate, 10 to 60 parts by weight of an inert filler such as zinc white, 0 to 5 parts by weight of an antioxidant and 0.3 to 5 parts by weight of a crosslinking agent such as dicumyl peroxide at a low temperature (136° to 150° C.) for a comparatively long period of time (20 to 50 minutes).

The term "surface layer of the core" used herein means a part of which distance from the core surface to the interior direction is not more than 2 mm. The surface hardness and sectional hardness are measured by a method described in JIS K 6301 (physical test method of vulcanized rubber) using a JIS-C type hardness tester. The surface hardness is a hardness of the surface of the core, and the sectional hardness is a hardness of core of the section of the core. In the surface hardness and sectional hardness, the measurement is conducted four times and the resulting average value is used.

When the surface hardness of the core is smaller than 55, the initial velocity of the golf ball is decreased, which results in deterioration of flying performances. On the other hand, when the surface hardness exceeds 75, the amount of spin is decreased. When the sectional hardness at the part other than the surface layer of the core is smaller than 65, the initial velocity of the golf ball is decreased. On the other hand, when it exceeds 85, it becomes too hard and the hit feeling becomes inferior.

It is preferred that the part other than the surface layer has an uniform hardness, because the spin performances are enhanced and the impact resilience is improved. Accordingly, the sectional hardness at any part other than the surface layer of the core is not more than 5, preferably not more than 3.

It is preferred that the surface hardness of the core is at least 5 smaller than the sectional hardness at the part other than the surface layer of the core. When this difference in hardness is smaller than 5, the spin performances are deteriorated.

The resulting core is coated with a cover having a thickness of 1.0 to 3.0 mm, preferably 1.3 to 2.5 mm. When the thickness of the cover is less than 1.0 mm or exceeds 3.0 mm, it is not easy to put spin on the golf ball and the hit feeling becomes inferior.

It is preferred to use an ionomer resin as a main material of the cover, because the resulting golf ball has a high impact resilience and is superior in durability and hit feeling. If necessary, inorganic fillers (e.g. titanium dioxide, barium sulfate, etc.) may be used in combination for the purpose of coloring.

Preferred examples of the ionomer resin include Himilane 1855, 1706, 1605, 1557, etc., which are commercially available from Mitsui Du Pont Polychemical Co., ESCOR EX951, 562, 900, etc. Which are commercially available from Exxon Co. and a combination thereof.

It is preferred to adjust the stiffness of the cover within a range of 1,000 to 3,000 kg/cm$^2$. When the stiffness is smaller than 1,000 kg/cm$^2$, the flying distance is insufficient. On the other hand, when the stiffness exceeds 3,000 kg/cm$^2$, the fit feeling becomes inferior.

In the above embodiment, the contact area between the golf ball and club at the time of driver shot is optimized by softening the core surface of the two-piece golf ball and further combining with a cover having a stiffness of 1,000 to 3,000 kg/cm$^2$, which is soft in comparison with the cover which is normally used, thereby providing the two-piece golf ball of the present invention.

In this embodiment, only the surface of the core is particularly softened and the hardness at the part other than the surface layer of the core is uniform and is a proper hardness so that the impact resilience is not deteriorated. Accordingly, the flying distance is not decreased. Further, the impact when hitting the golf ball can be absorbed by softening both core surface and cover, thereby obtaining a golf ball having a soft hit feeling and improved durability.

The amount of compression deformation of the resulting golf ball also exerts an influence on the hit feeling at the time of hitting and spin performances. The term "amount of compression deformation" used herein means an amount of deformation of the golf ball, which is formed between initial loading (10 kg) and final loading (130 kg). In the present invention, it is preferably 2.0 to 3.2 mm, particularly 2.5 to 3.0 mm. When the amount of compression deformation is smaller than 2.0 mm, the golf ball becomes too hard and the hit feeling becomes inferior. On the other hand, when it exceeds 3.2 mm, the golf ball becomes too soft, which results in deterioration of spin performances.

As described above, according to the present invention, there could be obtained a nearly ideal golf ball having enhanced spin performances and largely improved ball control properties at the time of iron shot as well as soft hit feeling while maintaining advantages of the two-piece golf ball, such. as excellent flying performances.

EXAMPLES

The following Examples and Comparative Examples further illustrate the present invention in detail but are not to be construed to limit the scope thereof.

Examples 1 to 4 and Comparative Examples 1 to 5

The respective components of the core formulation shown in Table 1 were kneaded to prepare a rubber composition, which was subjected to a vulcanization molding in a die under the vulcanizing condition shown in Table 1 to give seven kinds of cores (I to VII), respectively. The hardness distribution determined using a JIS-C type hardness tester is shown in Table 1.

The core thus obtained was coated with a cover (A to D), respectively, by an injection molding. Various physical properties of the L-size golf ball thus obtained are shown in Table 3.

TABLE 1

| | Core I | Core II | Core III | Core IV | Core V | Core VI | Core VII |
|---|---|---|---|---|---|---|---|
| Formulation | | | | | | | |
| Butadiene rubber*[1] | 100 | 100 | 100 | 100 | 100 | 100 | 100 |
| Zinc acrylate | 25.0 | 32.0 | 32.0 | 32.0 | 35 | 38 | 35 |
| Zinc oxide | 22.0 | 20.0 | 20.0 | 20.0 | 19.1 | 18.1 | 13.1 |
| Antioxidant*[2] | 0.50 | 0.50 | 0.50 | 0.50 | 0.50 | 0.50 | 0.50 |
| Dicumyl peroxide | 1.5 | 2.0 | 2.0 | 2.0 | 1.4 | 2.7 | 1.4 |
| Vulcanization | | | | | | | |

TABLE 1-continued

| | Core I | Core II | Core III | Core IV | Core V | Core VI | Core VII |
|---|---|---|---|---|---|---|---|
| Vulcanizing temperature (°C.) | 140 | 140 | 160 | 144 + 165 | 140 | 140 | 140 |
| Vulcanizing time (minutes) | 48 | 42 | 25 | 24 + 8 | 38 | 35 | 39 |
| Hardness distribution | | | | | | | |
| Center | 73.0 | 78.3 | 56.5 | 77.0 | 83.3 | 86.2 | 83.5 |
| Location which is 5 mm away from the center | 72.8 | 77.8 | 69.9 | 77.0 | 82.8 | 87.5 | 83.0 |
| Location which is 10 mm away from the center | 72.9 | 77.0 | 71.1 | 76.9 | 83.0 | 87.9 | 82.8 |
| Location which is 15 mm away | 72.9 | 77.8 | 76.0 | 76.9 | 82.5 | 88.6 | 82.3 |
| Surface | 65.1 | 66.7 | 78.1 | 77.1 | 70.3 | 75.8 | 71.0 |
| Core diameter | 38.4 | 38.4 | 38.4 | 38.4 | 38.4 | 38.4 | 39.8 |

*1: BR11, manufactured by Nihon Gosei Gomu Co., Ltd.
*2: Nocrac NS-6, manufactured by Ohuchi Shinko Co., Ltd.

TABLE 2

| | | Cover A | Cover B | Cover C | Cover D | Cover E |
|---|---|---|---|---|---|---|
| Formulation | | | | | | |
| Hi-milane | 1557*1 | | 10 | | | |
| | 1605*2 | | 20 | 50 | 5 | 20 |
| | 1705*3 | 20 | | | | |
| | 1706*4 | 60 | | 50 | 5 | |
| | 1855*5 | 20 | 70 | | | |
| | AD8625*7 | | | | 90 | |
| | TM5551-3*6 | | | | | 80 |
| Stiffness (kg/cm$^2$)*8 | | 2480 | 1370 | 3310 | 560 | 4500 |

*1 to *6: Ionomer resin, manufactured by Mitsui Du Pont Polychemical Co.
*7: Ionomer resin, manufactured by Du Pont Co.
*8: A composition for cover is subjected to a press molding and, after standing at 23° C. at a relative humidity of 50% for 2 weeks, the stiffness is measured by means of a sticks meter manufactured by Toyo Seiki Co., Ltd.

TABLE 3

| | Example | | | | Comparative Example No. | | | | | |
|---|---|---|---|---|---|---|---|---|---|---|
| | 1 | 2 | 3 | 4 | 1 | 2 | 3 | 4 | 5 | 6 |
| Core | I | II | III | V | III | IV | II | I | VI | VII |
| Cover | A | B | A | A | A | A | C | D | A | E |
| Thickness of cover (mm) | 2.2 | 2.2 | 2.2 | 2.2 | 2.2 | 2.2 | 2.2 | 2.2 | 2.2 | 1.5 |
| Amount of compression deformation (mm) | 2.9 | 2.8 | 2.6 | 2.4 | 2.8 | 2.6 | 2.4 | 3.3 | 1.9 | 2.3 |
| Ball initial velocity[a] (feet/second) | 249.6 | 248.3 | 250.3 | 251.6 | 250.3 | 250.4 | 252.3 | 240.2 | 252.3 | 254.3 |
| W#1 | | | | | | | | | | |
| Carry[b] (yard) | 231.4 | 230.3 | 232.3 | 233.0 | 227.4 | 228.7 | 233.3 | 215.3 | 233.1 | 233.4 |
| Spin[b] (rpm) | 2610 | 2970 | 2660 | 2640 | 2430 | 2410 | 2430 | 3060 | 3100 | 2870 |
| 1#9 | | | | | | | | | | |
| Carry[c] (yard) | 130.6 | 129.1 | 130.0 | 129.5 | 131.4 | 131.3 | 131.4 | 117.8 | 128.5 | 131.7 |
| Spin[c] (rpm) | 7710 | 7920 | 7760 | 7830 | 6630 | 6990 | 6940 | 8300 | 8310 | 6970 |
| Feeling at the time of hitting | Good | Good | Good | Good | Good | Slightly hard | Slightly hard | Too soft | Very soft | Slightly hard |
| Contact area[d] (cm$^2$) | 4.7 | 4.7 | 4.5 | 4.4 | 4.2 | 4.2 | 4.2 | 5.1 | 4.1 | 4.1 |
| Durability[e] | 115 | 139 | 100 | 149 | 69 | 103 | 87 | 148 | 133 | 88 |

[a]Ball initial velocity: It is measured by hitting with a driver at a head speed of 45 m/second, using a Swing Robot
[b]W#1 Carry, spin: They are measured by hitting with a driver at a head speed of 45 m/second, using a Swing Robot.
[c]1#9 Carry, spin: They are measured by hitting with an iron #9 at a head speed of 34 m/second, using a Swing Robot.
[d]Contact area: The area on the surface of a club contacted with a golf ball is determined by hitting with a driver at a head speed of 40 m/second, using a Swing Robot.
[e]Durability: It is determined by repeatedly striking a golf ball at a head speed of 45 m/second against an impact board to measure the number of times until it is broken. The resulting value is indicated as an index in case of the value of the golf ball of Example 3 being 100.

On comparing the golf balls of Examples 1 to 4 with those of Comparative Examples 1 and 2, the golf balls of Examples 1 to 4 showed a large carrier by a driver and large amount of spin by an iron #9 and were superior in durability and hit feeling in comparison with Comparative Examples 1 and 2. As described above, the golf ball attains a large distance by a driver and spin is easily put on the golf ball by a short iron in comparison with a conventional one, a two-piece golf ball having high control properties was obtained.

Further, regarding the golf ball of Comparative Example 3, the initial velocity of the golf ball is large and the large carry is attained because the stiffness of the cover is too large. On the contrary, the amount of spin is small and the durability and hit feeling are inferior so that it is not suitable for practical application. Regarding the golf ball of Comparative Example 4, since the cover is too soft, the hardness of the golf ball becomes too soft and spin is put but the flying distance is decreased, and it is not preferred. Regarding the golf ball of Comparative Example 5, since the interior hardness is too high, the hit feeling is inferior. Regarding the golf ball of Comparative Example 6 using a thin cover having a high rigidity in combination, the amount of spin is slightly large at the time driver shot but slip is arisen because of its too hard cover and, therefore, the amount of spin is not so large.

Further, an approach shot toward green (30 yards) was conducted by five professional golfers and five amateur golfers, and their evaluations are shown in Table 4. As a result, it was confirmed that the golf balls of Examples 1 to 4 attain large amount of spin at the time of iron #9 shot and stop on the green, frequently.

Regarding the golf ball of Comparative Examples 4, the similar results were obtained because of its soft cover, but the results, that they stops, frequently, were not obtained in those of Comparative Examples 1, 2, 3, 5 and 6. This is because that the combination of the rigidity of the cover, hardness of the core and surface hardness is not optimum so that a contact area of not less than 4.3 $cm^2$ at the time of impact is not obtained.

TABLE 4

| | Example No. | | | | Comparative Example No. | | | | | |
|---|---|---|---|---|---|---|---|---|---|---|
| | 1 | 2 | 3 | 4 | 1 | 2 | 3 | 4 | 5 | 6 |
| Ease of stopping of the golf ball in a practical hitting test | X | X | X | X | Z | Y | Y | X | Y | Y |

*Approach shot test (about 30 yards) using a pitching wedge
Practical feeling according to ten professional and amateur golfers
X: Not less than eight golfers answered that the golf ball stops on the green, frequently.
Y: Four to six golfers answered that the golf ball stops, frequently. On the other hand, six to four golfers answered that it hardly stops.
Z: Not less than eight golfers answers that the golf ball hardly stops.

What is claimed is:

1. A two-piece golf ball comprising a core and a cover covering said core, wherein said core has a surface hardness of 55 to 75 and a sectional hardness of 65 to 88 at the part other than the surface layer, which are measured by means of a JIS-C type hardness tester, and said cover has a stiffness of 1,000 to 3,000 kg/$cm^2$; said golf ball exhibiting a contact area between itself and a clubface of 4.3 to 5.0 $cm^2$ when hit with a driver at a head speed of 40 m/second.

2. The two-piece golf ball according to claim 1, wherein a variation in sectional hardness at the part other than the surface layer of the core is not more than 5.

3. The two-piece golf ball according to claim 2, wherein the surface hardness of the core is at least 5 smaller than that of the sectional hardness at the part other than the surface layer of the core.

4. The two-piece golf ball according to claim 1, wherein the surface hardness of the core is at least 5 smaller than that of the sectional hardness at the part other than the surface layer of the core.

5. The two-piece golf ball according to claim 1, wherein the cover contains an ionomer resin as a main material.

6. The two-piece golf ball according to claim 1, wherein an amount of compression deformation formed between initial loading (10 kg) and final loading (130 kg) is 2.0 to 3.2 mm.

7. The two-piece golf ball according to claim 6, wherein said golf ball exhibits compression deformation in an amount between 2.5 and 3.0 mm between an initial loading (10 kg) and a final loading (130 kg).

8. The two-piece golf ball according to claim 1, wherein said core is comprised of vulcanized 1,4-polybutadiene rubber having at least 40% of a cis structure.

9. The two-piece golf ball according to claim 1, wherein said core was formed by vulcanizing a base rubber, a crosslinking agent, and zinc acrylate as a co-crosslinking agent.

10. The two-piece golf ball according to claim 9, wherein said core further comprises 10 to 60 parts by weight per 100 parts by weight of the base rubber, of an inert filler.

11. The two-piece golf ball according to claim 1, wherein said cover has a thickness of 1.3 to 2.5 mm.

12. The two-piece golf ball according to claim 11, wherein said cover contains an ionomer resin.

13. A two-piece golf ball, comprising:

a core having a surface hardness of 55 to 75 and a sectional hardness at the location other than the core surface layer of 65 to 88, said hardness value being determined by a JIS-C type hardness tester; and a cover covering said core and having a stiffness of 1,000 to 3,000 kg/$cm^2$;

wherein said golf ball exhibits a contact area S between itself and a clubface, when hit with a driver at a head speed of 40 m/second, of 4.3 to 5.0 $cm^2$, S being determined by the equation:

$$S=\pi(\tfrac{1}{2}\{(a+b)/2\})^2$$

wherein a is a transverse diameter of the contact area and b is a longitudinal diameter of the contact area.

* * * * *